United States Patent [19]

Asakawa et al.

[11] Patent Number: 5,060,268

[45] Date of Patent: Oct. 22, 1991

[54] SPEECH CODING SYSTEM AND METHOD

[75] Inventors: Yoshiaki Asakawa, Kawasaki; Takanori Miyamoto, Fuchu; Kazuhiro Kondo, Kokubunji; Akira Ichikawa, Musashino; Toshiro Suzuki, Tama, all of Japan

[73] Assignee: Hitachi, Ltd., Tokyo, Japan

[21] Appl. No.: 15,025

[22] Filed: Feb. 17, 1987

[30] Foreign Application Priority Data

Feb. 21, 1986 [JP] Japan ..... 61-35148

[51] Int. Cl.[5] ..... G10L 5/00

[52] U.S. Cl. ..... 381/38; 381/79

[58] Field of Search ..... 381/49, 38; 364/513.5

[56] References Cited

U.S. PATENT DOCUMENTS 3,975,587 8/1976 Dunn et al. ..... 179/1 SA
3,979,557 9/1976 Schulman et al. ..... 381/49
4,354,057 10/1982 Atol ..... 364/513.5

OTHER PUBLICATIONS

Ichikawa, "A Speech Coding Method Using Thinned--Out Residual," 1985, All, ICASSP85.

Digital Processing of Speech Signals, L. R. Rabiver, R. W. Schafer, Prentice-Hall, 1978, pp. 150, 151.

*Primary Examiner*—Emanuel S. Kemeny

*Attorney, Agent, or Firm*—Antonelli, Terry, Stout & Kraus

[57] ABSTRACT

In a speech coding method and system in which a speech signal is analyzed in each frame so as to be separated into spectral envelope information and excitation information and both of the information are coded, each frame is divided into a plurality of sub-frames and a pulse of the maximum-amplitude is extracted from pulses within each sub-frame in order to provide large-amplitude pulses from each frame, thereby greatly reducing the number of pulse extracting processing steps.

12 Claims, 7 Drawing Sheets

INPUT SPEECH

THE RESIDUAL PULSE TRAIN

THE REGENERATED RESIDUAL PULSE TRAIN

SPEECH CODING SYSTEM AND METHOD

BACKGROUND OF THE INVENTION

The present invention relates to speech coding and more particularly to improvements in extraction and coding of sound source or excitation information directed to reduction of the number of processing steps.

As a-coding system suitable for compressing speech information to 8 to 16 k bps, there is available a thinned-out residual (TOR) method proposed by the present applicants. See Japanese Patent Application No. 59-5583 or Akira Ichikawa et al "A SPEECH CODING METHOD USING THINNED-OUT RESIDUAL", ICASSP 85, 1985. The TOR method intends to improve the quality of coded speech by making more precise the excitation of a linear predictive coding (LPC) vocoder system such as a partial autocorrelation (PARCOR) system. In the TOR method, to compress the information, pulses of less importance from the standpoint of quality are thinned out or decimated from a predictive residual pulse train as a predictive error resulting from the LPC analysis effected in a unit of a frame of a voice or speech data signal. The TOR concludes that residual pulses of smaller amplitude are permitted to be decimated in preference to those of larger amplitude and it does not require any error evaluation computation for decimation, thus succeeding in reducing the number of processing steps to some extent.

However, to effect the decimation of the small amplitude residual pulses (in other words, to effect the extraction of large amplitude pulses), the TOR method requires a process for sorting a number of residual pulses in one frame (amounting to 160 pulses where the sampling rate is 8 KHz and the frame period is 20 mS) and faces difficulties in making the system compact.

SUMMARY OF THE INVENTION

An object of the present invention is to provide a speech coding system and method capable of greatly reducing the number of processing steps required for extracting large amplitude pulses from residual pulses.

According to the present invention, to accomplish the above object, one frame of a residual signal is divided into a plurality of sub-frames and large amplitude pulses are extracted from residual pulses within individual sub-frames.

Preferably, by making the number of pulses to be extracted coincident with the number of sub-frames and extracting a peak or maximum amplitude pulse within each sub-frame, the necessity of sorting processing can be eliminated completely to promote the reduction of the number of processing steps required for coding.

Assuming that one frame contains N residual pulses and M large amplitude pulses are extracted from the N residual pulses; $M(2N-M-1)/2$ comparison operations are generally needed and in the worst case the same number of data exchange procedures will become necessary. Contrary to this, when it comes to dividing one frame into K sub-frames to define N/K pulses within each sub-frame and extracting M/K pulses from the N/K pulses in preference of the magnitude of amplitude, $M(2N-M-K)/2.K)$ comparison operations suffice, indicating that the number of processing steps is less than 1/K of that of the case in which on frame is not divided into sub-frames.

DESCRIPTION OF THE PREFERRED EMBODIMENTS

The invention will now be described by way of example with reference to FIGS. 1 to 6.

Figure 1A:
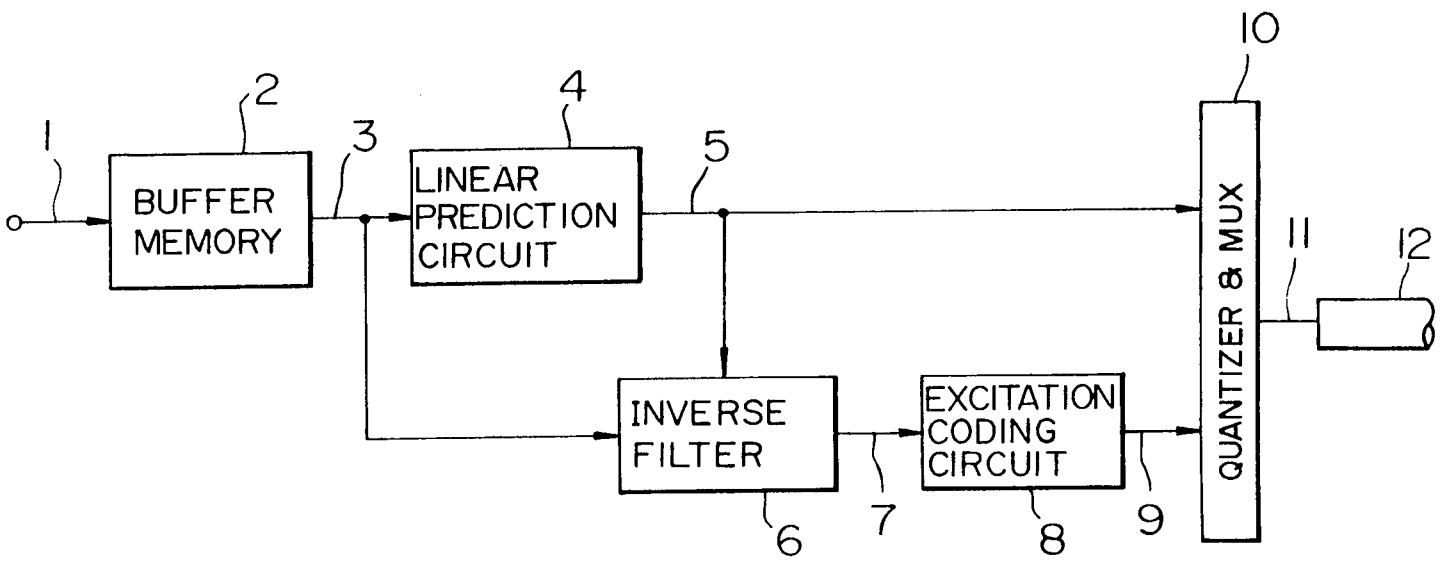
FIGS. 1*a* and 1*b* are block diagrams schematically illustrating a coder and a decoder of a speed coding-decoding system according to an embodiment of the invention, respectively.
Figure 1B:
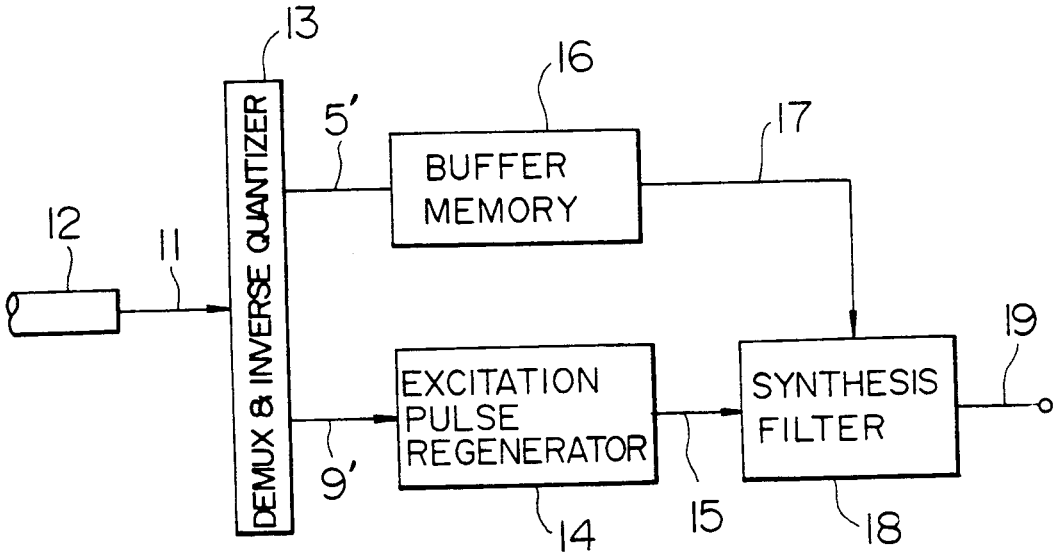

Referring particularly to FIGS. 1*a* and 1*b*, there is illustrated in block form a speech coding-decoding (CODEC) system incorporating the present invention. In a coder (transmitter) shown in FIG. 1*a*, one frame of a digitized speech signal 1 is stored in a buffer memory 2 and then read out of the buffer memory as a speech signal 3 which in turn is converted by a known linear prediction circuit 4 into a parameter signal 5 such as a partial autocorrelation coefficient signal representative of a spectral envelope. The parameter signal 5 is applied to an inverse filter 6, which is also connected to receive the speech signal 3 from the buffer memory 2 to extract a residual signal 7. The residual signal is almost removed of the influence of formant which prevails in the speech signal and its frequency spectrum is almost white. The residual signal is supplied to an excitation coding circuit 8 featuring the present invention and the excitation coding circuit 8 extracts residual pulses representing the frame to deliver an information signal 9 indicative of amplitude and location of the pulses.

The parameter signal 5 representative of the spectral envelope and the representing residual pulse location and amplitude information signal 9 are quantized with a predetermined number of bits and converted into an encoded data signal 11 of a predetermined format by means of a quantizer and multiplexer 10, the encoded data signal 11 being delivered to a digital transmission line 12.

The data signal 11 sent through the digital transmission line 12 is received by a decoder (receiver), shown in FIG. 1*b*, at its demultiplexer and inverse quantizer 13 which separates the data signal into a parameter signal 5' representative of the spectral envelope and a representing residual pulse location and amplitude information signal 9'. The information signal 9' is supplied to an excitation pulse regenerator 14 featuring the present invention and an excitation pulse train (a pseudo-residual pulse train) 15 is regenerated from the regenerator 14. On the other hand, the decoded parameter signal 5' representative of the spectral envelope is supplied to a buffer memory 16 and after expiration of a delay time required by the excitation pulse regenerator 14, is delivered out of the buffer memory 16 as a coefficient signal 17 used for a synthesis filter 18. By receiving the regenerated excitation pulse train 15, the synthesis filter 18 produces a synthesized speech signal 19.

Figure 2:
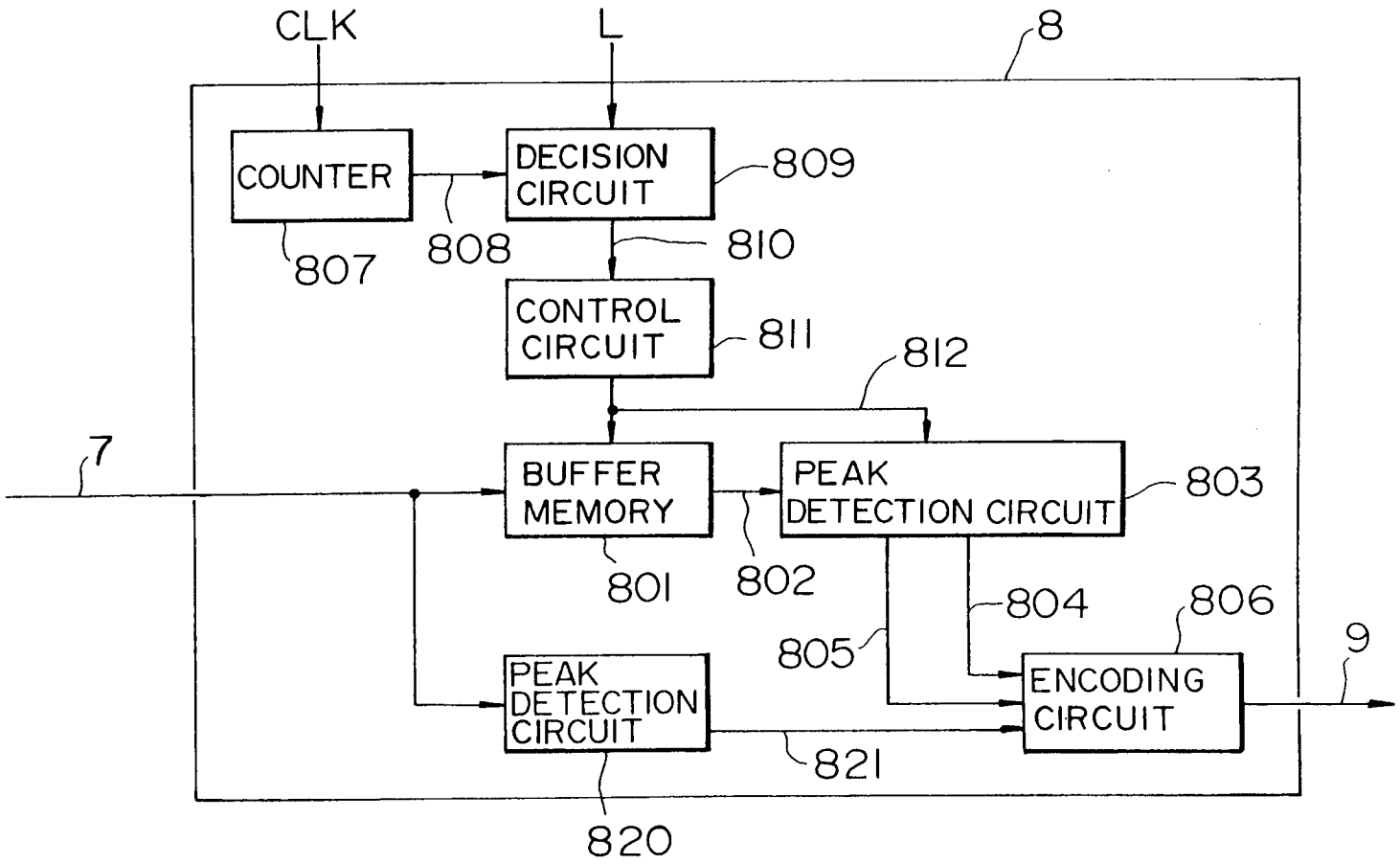
FIG. 2 is a block diagram illustrating an excitation coding circuit.

The function of the excitation coding circuit 8 will now be described in more detail with reference to FIG. 2. The received residual signal 7 of one frame is first stored in a buffer memory 801 and a residual pulse train 802 for each sub-frame is transferred to a peak detection circuit 803 at the rate of the sub-frame so that one of the residual pulses within respective sub-frames which has a peak amplitude in absolute value is detected, and a signal 804 indicative of its location (its address within the sub-frame) and a signal 805 indicative of its amplitude are supplied to an encoding circuit 806. One frame is divided into sub-frames as will specifically be described below. A counter 807 counts up in synchronism with a data read clock CLK to produce an output signal 808 indicative of a value or count of I. When the count I coincides with a sub-frame length L, a decision circuit 809 detects the coincidence and produces a coincidence signal 810 which controls a control circuit 811. In response to the coincidence signal 810, the control circuit 811 produces a control signal 812 which causes the buffer memory 801 to stop reading. In this way, one sub-frame is clipped off from the one frame. This operation is reiteratively repeated until all of the data within the one frame has been read.

In the simplest case, the detected location and amplitude signals 804 and 805 are not modified or altered in the encoding circuit 806 and are delivered therefrom as a signal 9. On the other hand, however, the amplitude may be normalized by a peak amplitude within one frame. To this end, it is necessary to detect a peak amplitude pulse signal 821 from all the residual pulses within one frame by using a peak detection circuit 820. The normalization of the amplitude is advantageous in that even with the number of bits for quantization being far smaller for the normalized amplitude than for the non-normalized amplitude, degradation in voice quality can be suppressed. When considering the number of bits used for designating the locations of the representing residual pulses, it can be smaller when the locations of the residual pulses are expressed in terms of addresses within a sub-frame than when they are expressed in terms of addresses within a frame. In some applications, the resolution of the pulse location is not always required to be equal to that of the sampling point and the number of bits for quantization of the addresses within a sub-frame can be reduced. For example, when the sampling rate is 8 KHz and the sub-frame length is 2 mS thus allowing one sub-frame to contain 16 samples, 4 bits have to be used to accurately express the pulse locations within a sub-frame. But, under the stipulation that either of original pulses respectively having address n and address (n+1) is decoded into a pulse of address n to accept the accuracy or resolution of the pulse location being of the order of two samples, quantization of the addresses can be achieved using 3 bits.

Figure 3:
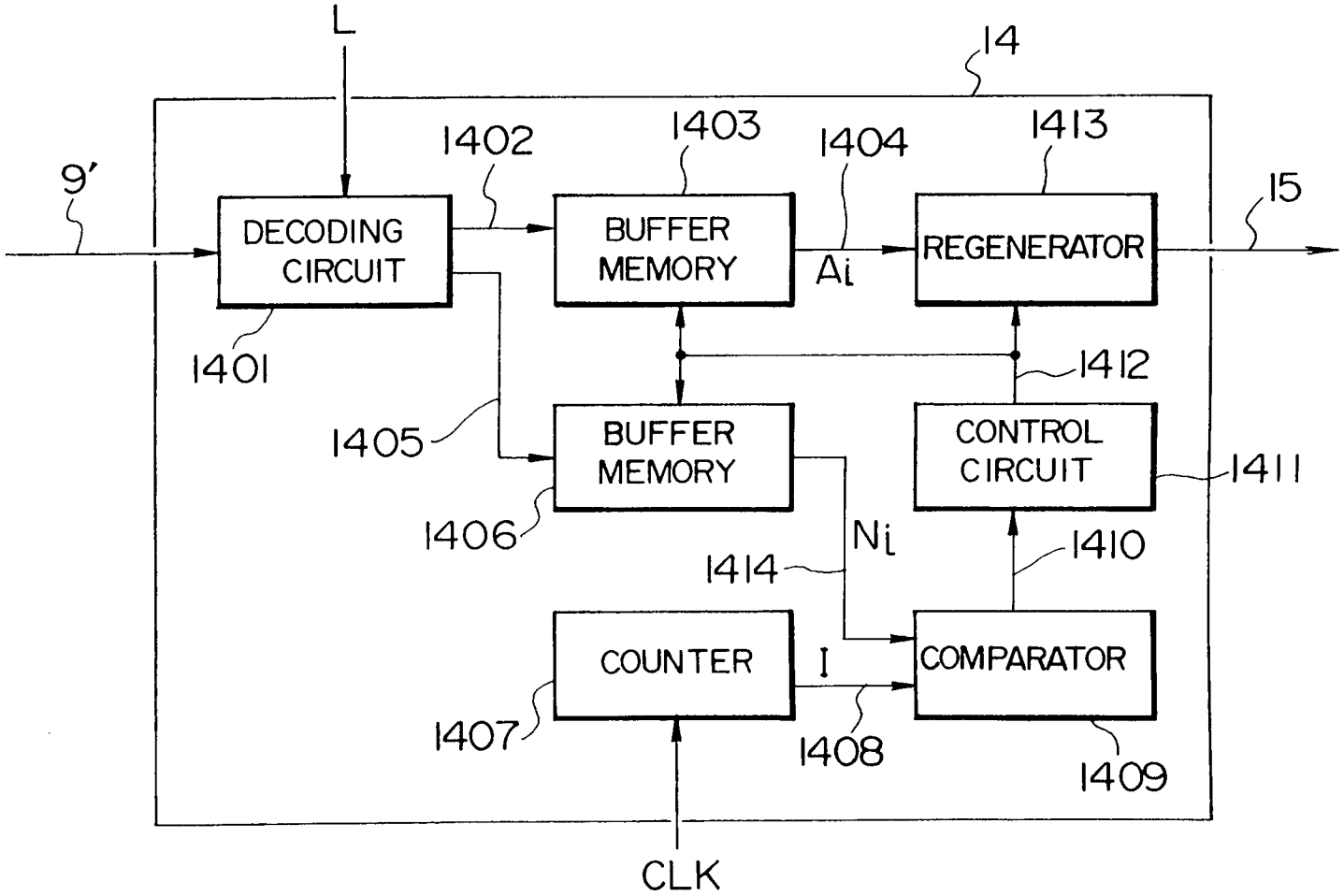
FIG. 3 is a block diagram illustrating an excitation pulse regenerator.
Figure 4A:
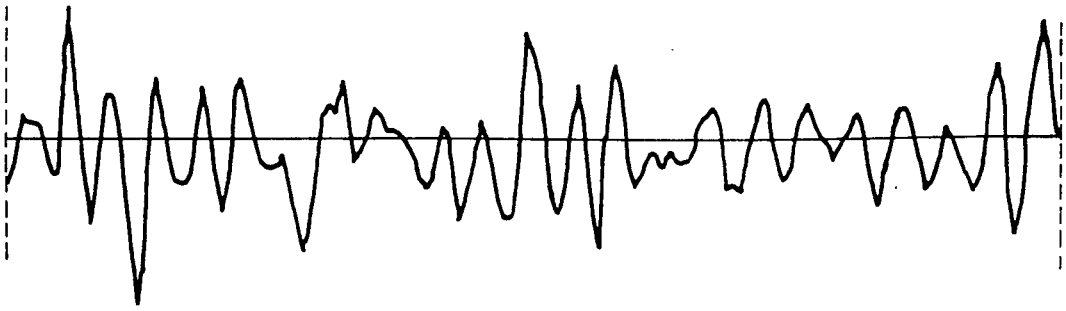
FIGS. 4*a*, 4*b* and 4*c* illustrate a regenerated residual pulse train obtained in accordance with the invention, in reference to an input speech and a related residual pulse train.
Figure 4B:
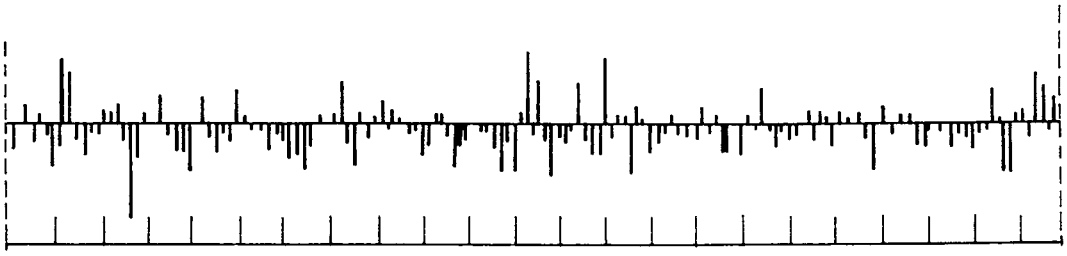
Figure 4C:
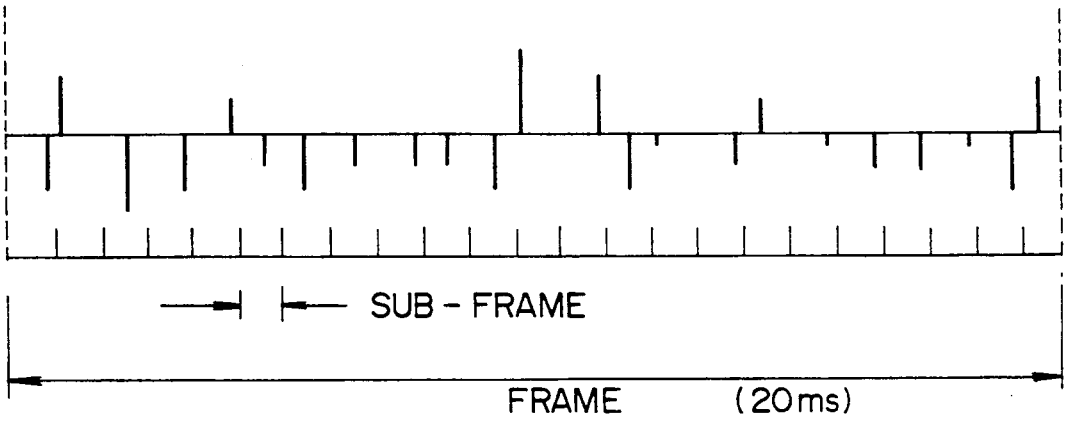

The function of the excitation pulse regenerator 14 included in the decoder will now be described with reference to FIG. 3. A data signal 9' indicative of the location and amplitude of the representing residual pulses is converted by a decoding circuit 1401 into data signals of predetermined formats. More particularly, where the received amplitude information contains a peak amplitude and a normalized amplitude set, the normalized amplitude is multiplied by the peak amplitude to provide a decoded amplitude signal 1402, which is stored in a buffer memory 1403. Where the amplitude information is not normalized, it is directly sent to the buffer memory 1403 for storage therein. Since the received location information is represented by addresses as viewed from sub-frames, it is so converted as to be represented by addresses as viewed from a frame. Specifically, on the assumption that an address of the representing residual pulse within the i-th sub-frame is represented by $n_i$ where i=1 to NRES, NRES being the number of representing residual pulses per frame and the length of each sub-frame is L, the address $n_i$ is converted into an address Ni as viewed from a frame, which is:

$$Ni=(i-1)\cdot L+n_i.$$

A signal 1405 indicative of this address Ni is stored in a buffer memory 1406. To regenerate the excitation pulse train (pseudo-residual pulse train), a signal 1404 indicative of amplitude Ai of the i-th representing residual pulse (i=1 to NRES) is supplied to a regenerator 1413 and a signal 1414 indicative of its address Ni is supplied to a comparator 1409. A counter 1407 counts up in synchronism with the clock CLK and produces an output signal 1408 indicative of a count of I to the comparator 1409. The comparator 1409 produces an output signal 1410 indicating whether I coincides with Ni, and a control circuit 1411 operates in accordance with the signal 1410 to produce a control signal 1412 which causes the regenerator 1413 to provide a signal 15 representative of Ai when I coincides with Ni and representative of "0" when the coincidence is not obtained. With the delivery of Ai from the regenerator 1413, $A_{i+1}$ is read out of the buffer memory 1403 and $N_{i+1}$ is read out of the buffer memory 1406. The above operation is repeated reiteratively until I coincides with the frame length, thereby completing the regeneration of the excitation pulse train. The thus regenerated excitation pulse train is exemplified in FIG. 4 where an input speech is illustrated at section (a), a residual pulse train at section (b) and a regenerated residual pulse train at section (c).

In the foregoing embodiment, the sub-frame length L is fixed as in the case of typical applications. But the sub-frame length may be set unequally in an application wherein dependent on the relation between the frame length, LNTH, and the number of transmitting residual pulses NRES which equals the number of sub-frames within one frame since the sub-frame is represented by the residual pulse, there occurs a difference between the frame length and the sum of the sub-frame lengths, indicating $L\cdot NRES\neq LNTH$. In this case, sub-frames in one frame are sorted, for example, into $n_1$ sub-frames each having a length $l_1$ in the first half and $n_2$ sub-frames each having a length $l_2$ in the second half, and $l_1$, $l_2$, $n_1$ and $n_2$ are prescribed pursuant to the following formulas:

$$\left.\begin{aligned} & n_1 + n_2 = NRES \\ & n\cdot l_1 + n_2\cdot l_2 = LNTH \\ & l_1 \geqq LNTH/NRES \geqq l_2 \geqq 1 \\ & n_1 \geqq 0 \\ & n_2 \geqq 0 \end{aligned}\right\}$$

Taking LNTH=160 and NRES=30, for instance, there result $l_1=6$, $l_2=5$, $n_1=10$ and $n_2=20$ and the frame can be divided into sub-frames substantially uniformly by avoiding extremes. To meet the use of the sub-frames of unequal lengths, the sub-frame length L used in the excitation coding circuit 8 and excitation pulse regenerator 14 must be changed in accordance with sub-frame numbers. Obviously this may be accomplished by means of a general-purpose microprocessor or by using a program of a digital signal processor.

Figure 5:
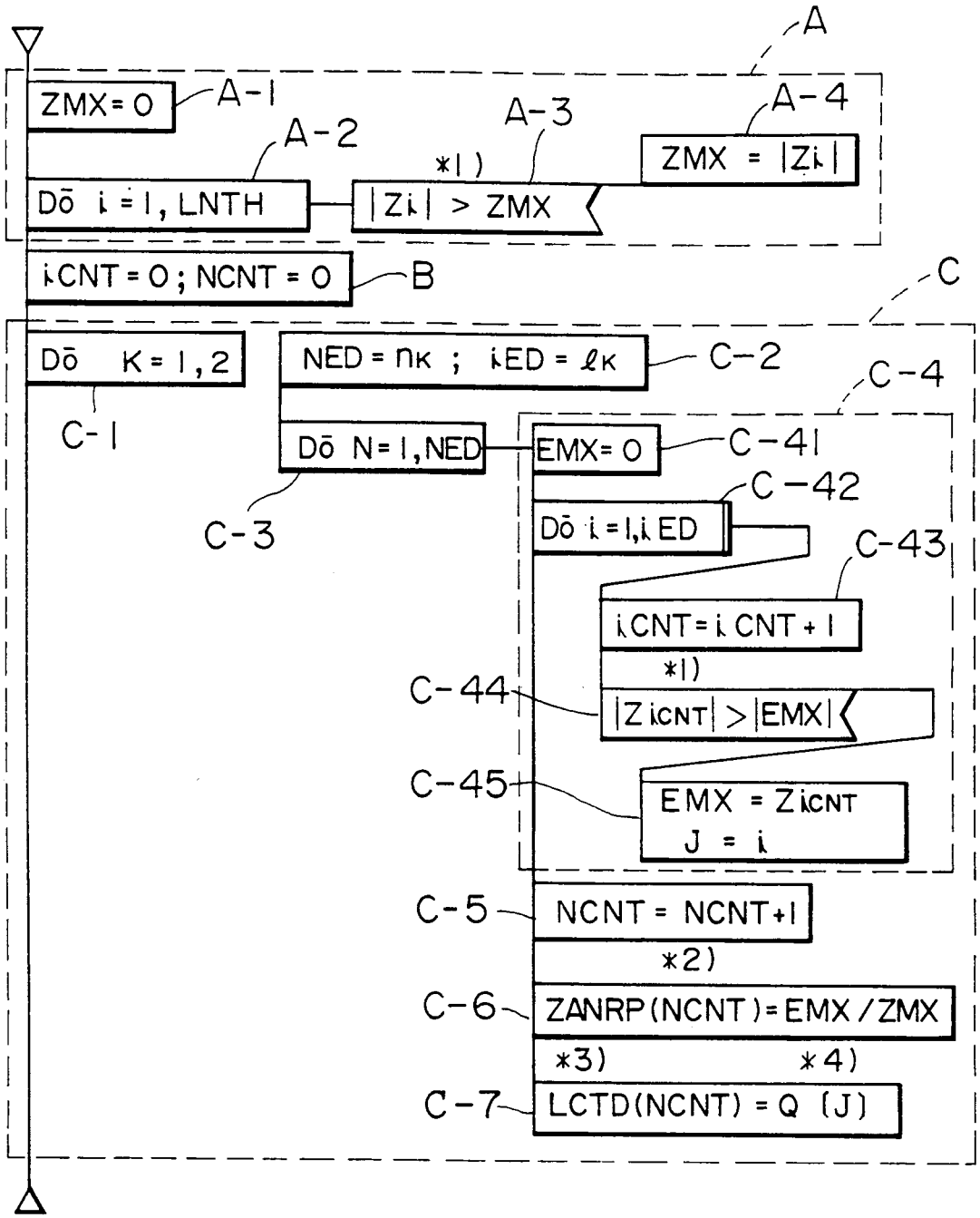
FIGS. 5 and 6 are diagrams illustraing operational flows for implementing the invention.
Figure 6:
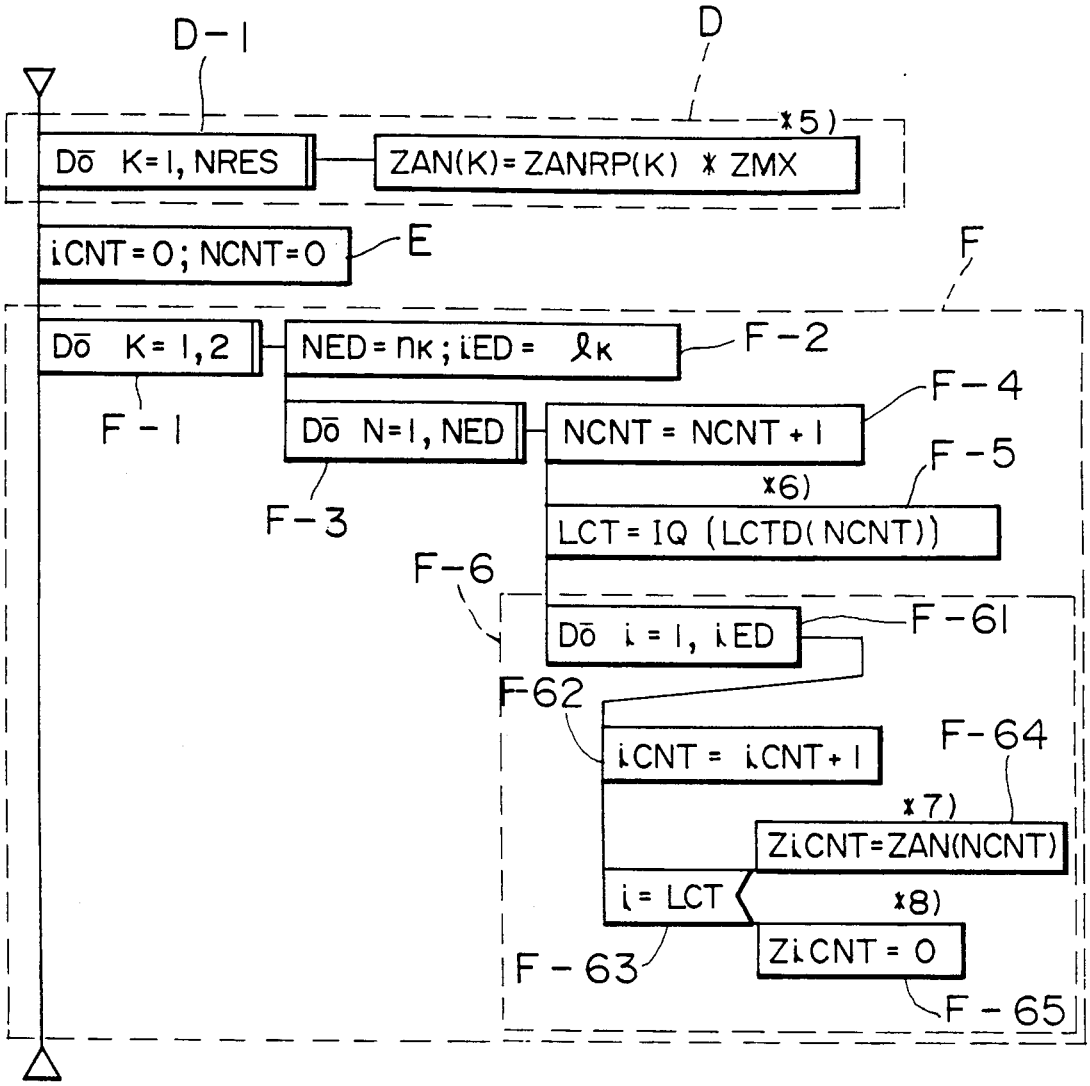

FIG. 5 illustrates a flow of operations of the excitation coding circuit based on a program and FIG. 6 illustrates a flow of operations of the excitation pulse regenerator based on a program. In FIGS. 5 and 6, 1) Zi: amplitude of a residual pulse having an address i, 2) ZANRP(NCNT): normalized amplitude of NCNT-th representing residual pulse, 3) LCTD(NCNT): location of the NCNT-th representing residual pulse, 4) Q[J]: quantization of an address J within sub-frame, 5) ZMX: peak amplitude, 6) IQ[LCTD(NCNT)]: inverse quantization of quantized location information LCTD(NCNT) of the NCNT-th representing residual pulse, and 7) $Z_{iCNT}$ amplitude of a residual pulse having an address iCNT.

Referring to FIG. 5, a block A is for determining a peak amplitude $Z_{MX}$ in absolute value of a residual pulse $Z_1$ within one frame. In a sub-block A-1, the peak amplitude $Z_{MX}$ is initialized to zero. In a sub-block A-2, the address i of residual pulse in the frame is incremented one by one from 1 (one) to LNTH. In a sub-block A-3, it is decided whether the absolute value of amplitude $|Z_i|$ of the residual pulse is larger than a peak candidate $Z_{MX}$ previously set. If $|Z_i| > Z_{MX}$, $Z_{MX}$ is set to $|Z_i|$.

A block B is for initializing the counter. An address of a residual pulse within the frame is represented by iCNT and the number of residual pulses to be extracted, equalling the number of sub-frames, is represented by NCNT.

A block C is for extracting a residual pulse of peak amplitude from a sub-frame and coding its amplitude and location In a sub-block C-1, one frame is divided into two portions of the first half (K=1) and the second half (K=2) which are processed sequentially. In a sub-block C-2, the number of sub-frames NED in either of the first half and the second half and the number of residual pulses iED within each sub-frame are set, and $n_1$, $n_2$, $l_1$ and $l_2$ are held as constants (predetermined in the above-mentioned formulas). In a sub-block C-3, individual sub-frames in either of the first half and the second half are processed sequentially. A sub-block C-4 is for determining amplitude $E_{MX}$ of a residual pulse having a peak amplitude in absolute value within one sub-frame and its location J within the sub-frame. To this end, in a section C-41, $E_{MX}$ is initialized. In a section C-42, the address i of residual pulse in the sub-frame is incremented one by one from 1 (one) to iED. In a section C-43, the address iCNT of residual pulse in the frame is incremented in synchronism with the procedure of section C-41. In a section C-44, it is decided whether $|Z_{iCNT}|$ is larger than $|E_{MX}|$. When $|Z_{iCNT}|$ is decided to be larger in section C-44, $E_{MX}$ is set to $Z_{iCNT}$ and J is set to i (address within sub-frame) in a section C-45. In a sub-block C-5, the extracted residual pulse number is incremented one by one. In a sub-block C-6, the amplitude $E_{MX}$ of the extracted residual pulse is divided by peak amplitude $Z_{MX}$ within frame so as to be normalized and stored in a pre-allocated store location (array) of computation results per a computer program, as NCNT-th normalized amplitude ZANRP(NCNT) where ZANRP(NCNT) represents an NCNT-th element of the array ZANRP. In a sub-block C-7, the location (address within sub-frame) of the extracted residual pulse is quantized with a predetermined number of bits and stored as NCNT-th location LCTD(NCNT).

The quantization is effected by using a look-up table which is exemplified as below for quantization of two bits when the number of pulses iED within sub-frame is seven.

| Input | Quantization | Inverse quantization |
|---|---|---|
| 1, 2 | 0 | 1 |
| 3, 4 | 1 | 3 |
| 5, 6 | 2 | 5 |
| 7 | 3 | 7 |

Turning to FIG. 6, a block D is for decoding the normalized amplitude into actual amplitude. In a sub-block D-1, number K of the extracted residual pulse is incremented one by one from 1 (one) to NRES, where $NRES = n_1 + n_2$. In a sub-block D-2, normalized amplitude ZANRP(K) is multiplied by peak amplitude $Z_{MX}$ within frame to obtain decoded amplitude ZAN(K).

A block E is indentical to the block B in FIG. 5 and will not be described.

A block F is for decoding residual pulses within frame from the extracted residual pulse information (amplitude and location). The processing is carried out in unit of sub-frame. Sub-blocks F-1, F-2 and F-3 are identical to the sub-blocks C-1, C-2 and C-3 in FIG. 5. In a sub-block F-4, the extracted residual pulse number (equal to the sub-frame member) is incremented. In a sub-block F-5, quantized location information LCTD(NCNT) is subjected to inverse quantization so as to be decoded into address LCT within sub-frame. Practically, this processing is performed by using the look-up table as explained in connection with FIG. 5 flow. In a sub-block F-6, the residual pulse within sub-frame is decoded. Sections F-61 and F-62 are identical to the sections C-42 and C-43 in FIG. 5. In a section F-63, it is decided whether the address within sub-frame coincides with the decoded residual pulse location LCT. When the address is decided to be coincident in the section F-63, the residual pulse amplitude $Z_{iCNT}$ at address iCNT within frame is set to ZAN(NCNT) in a section F-64. When the address is decided not to be coincident in the section F-63, the $Z_{iCNT}$ is set to zero in a section F-65.

As described above, according to the invention, the number of processing steps can be reduced to less than 1/K of that of the conventional method (K being the number of sub-frames) by replacing the sorting processing of the residual pulses within frame required for extracting the excitation pulses (representing residual pulses) pursuant to the TOR method with the detection of the peak amplitude of the residual pulses within sub-frame. Further, the representing residual pulse location information can be expressed in terms of the address within sub-frame and the amount of information (the number of bits) per pulse can be reduced as compared to the case of expressing the location in terms of the address within frame, ensuring that the number of pulses can be increased correspondingly to improve the quality of the coded speech.

We claim:

1. A speech coding system comprising:

memory means for storing successive frames of a digitized speech signal;

means connected to said memory means for producing a parameter signal representative of a spectral envelope of said speech signal by analyzing said digitized speech signal for each of said successive frames;

means including an inverse filter connected to receive said digitized speech signal and said parameter signal for producing a residual pulse train for each frame of said digitized speech signal;

excitation extracting means coupled to said inverse filter for dividing said residual pulse train for each frame into a plurality of sub-frames and for extracting a pulse having a peak amplitude from said residual pulse train within each sub-frame, and including means for producing an information signal indicative of the amplitude and location of said peak amplitude pulse as excitation information; and coding means coupled to said parameter signal producing means and said excitation extracting means for coding said parameter signal and said information signal to produce a coded speech signal.

2. A speech coding system according to claim 1, wherein said parameter signal producing means comprises a linear prediction circuit producing a partial auto correlation coefficient signal as said parameter signal.

3. A speech coding system according to claim 1, wherein said information signal producing means includes means for detecting the location of said peak amplitude residual pulse with respect to the sub-frame in which said peak amplitude residual pulse is located.

4. A speech coding system according to claim 1 wherein each sub-frame has an equal length.

5. A speech coding system according to claim 1 wherein the lengths of respective sub-frames are unequally distributed within a frame.

6. A speech coding system according to claim 5 wherein said excitation extracting means further includes means for dividing each frame into $n_1$ sub-frames each having a length $l_1$ in the first half of the frame and $n_2$ sub-frames each having a length $l_2$ in the second half of the frame, wherein $l_1$, $l_2$, $n_1$ and $n_2$ are prescribed pursuant to the following formulas:

$$\left.\begin{aligned} & n_1 + n_2 = NRES \\ & n \cdot l_1 + n_2 \cdot l_2 = LNTH \\ & l_1 \geqq LNTH/NRES \geqq l_2 \geqq 1 \\ & n_1 \geqq 0 \\ & n_2 \geqq 0 \end{aligned}\right\}$$

where NRES represents the number of extracted peak amplitude pulses per frame and LNTH represents the frame length in residual pulses.

7. A speech coding system according to claim 1, wherein said excitation extracting means comprises buffer means for storing one frame of said residual pulse train, peak detection means coupled to said buffer means for detecting a peak amplitude pulse in each sub-frame of said residual pulse train, and timing means for controlling said buffer means to transfer successive sub-frames of said residual pulse train to said peak detection means.

8. A speech coding system according to claim 7, wherein said timing means comprises counter means for counting clock pulses of a clock signal which represents the frequency of the pulses in said residual pulse train, coincidence means connected to said counter means and responsive to a length indicating signal indicative of a number of residual pulses in a sub-frame for producing a coincidence output signal when the count of said counter means coincides with said length indicating signal, and control means responsive to said coincidence output signal for controlling said buffer means to transfer a sub-frame of residual pulses to said peak detection means.

9. A speech coding system according to claim 7, wherein said excitation extracting means further comprises means coupled to said peak detection means for normalizing the peak amplitude pulse detected in each sub-frame on the basis of the peak amplitude pulse for the frame.

10. A speech coding system comprising:

memory means for storing successive frames of a digitized speech signal;

means connected to said memory means for producing a parameter signal representative of a spectral envelope of said speech signal by analyzing said digitized speech signal for each of said successive frames;

means including an inverse filter connected to receive said digitized speech signal and said parameter signal for producing a residual pulse train for each frame of said digitized speech signal;

excitation extracting means coupled to said inverse filter for dividing said residual pulse train for each frame into a plurality of sub-frames and for extracting a pulse having a peak amplitude from said residual pulse train within each sub-frame, and including means for producing an information signal indicative of the amplitude and location of said peak amplitude pulse as excitation information;

coding means coupled to said parameter signal producing means and said excitation extracting means for coding said parameter signal and said information signal to produce a coded speech signal;

decoding means connected to receive said coded speech signal for producing a parameter signal representative of a spectral envelope of said speech signal and an information signal identifying a residual pulse location and amplitude of a pulse for each successive sub-frame of a frame;

regenerator means coupled to said decoding means for generating an excitation pulse train based on said residual pulse location and amplitude information indicated by said information signal; and means, coupled to said coding means and said regenerator means and including a synthesis filter, for producing a synthesized speech signal in response to said parameter signal and said excitation pulse train.

11. A speech coding/decoding system according to claim 10, wherein said regenerator means includes means for dividing said received coded speech signal into sub-frame portions and for producing a pulse amplitude indicating signal and a pulse location indicating signal for each sub-frame portion, and pulse generating means responsive to said pulse amplitude indicating signal and pulse location indicating signal in each sub-frame portion for producing said excitation pulse train.

12. A speech coding method comprising the steps of:

analyzing successive frames of a digitized speech signal in each frame so as to produce a parameter signal representing a spectral envelope of said speech signal;

producing a residual pulse train in accordance with said parameter signal and said speech signal for each frame of said speech signal;

dividing each frame of said residual pulse train into a plurality of sub-frames;

detecting a pulse having peak amplitude from the residual pulse train within each sub-frame and its location; and coding a location and amplitude of said detected peak amplitude residual pulse for each sub-frame into excitation information.

* * * * *